United States Patent [19]

Breslow

[11] Patent Number: 4,830,201

[45] Date of Patent: May 16, 1989

[54] SPRING-URGED SHELF DIVIDER SYSTEM

[75] Inventor: David S. Breslow, Chicago, Ill.

[73] Assignee: RTC Industries, Inc., Chicago, Ill.

[21] Appl. No.: 180,179

[22] Filed: Apr. 11, 1988

[51] Int. Cl.[4] ..... A47F 5/00

[52] U.S. Cl. ..... 211/184; 211/59.3

[58] Field of Search ..... 211/184, 43, 59.3, 59.2, 211/51, 11; 312/71, 45; 108/60, 61

[56] References Cited

U.S. PATENT DOCUMENTS

| | | | |
|---|---|---|---|
| 3,308,961 | 3/1967 | Chesley | 211/59.3 |
| 4,300,693 | 11/1981 | Spamer | 211/59.3 |
| 4,303,162 | 12/1981 | Suttles | 211/59.3 |
| 4,730,741 | 3/1988 | Jackle, III et al. | 211/59.3 |

*Primary Examiner*—Reinaldo P. Machado

*Assistant Examiner*—Sarah A. Lechok Eley

*Attorney, Agent, or Firm*—Dressler, Goldsmith, Shore, Sutker & Milnamow, Ltd.

[57] ABSTRACT

A shelf divider system comprising a divider wall mountable in a channel member secured to the front of a shelf. A spring-urged pusher member is slidably mounted on a track having a pair of rails integral with the divider shaft. In one embodiment, the operationally mounted divider wall is vertically oriented and the pusher member extends horizontally therefrom so that displayed merchandise resets directly on the shelf surface but is automatically urged forwardly by the retracted pusher member. In another embodiment, the track provides the supporting surface for displayed merchandise and a vertical divider wall is integrally formed with the track.

9 Claims, 3 Drawing Sheets

SPRING-URGED SHELF DIVIDER SYSTEM

TECHNICAL FIELD

This invention relates to merchandise display shelf divider systems and, more particularly, to space dividers for existing display shelves having self-contained means for automatically feeding the merchandise forwardly.

BACKGROUND OF THE INVENTION

Display shelf divider systems are well known and widely employed, particularly in self-service stores, and the like. A representative example of a shelf divider system is shown and described in U.S. Pat. No. 4,712,694, that system comprising an elongated channel that is adhesively secured to the top surface of a shelf. Rearwardly extending divider elements are snap-fittable in the channel and are laterally adjustable to obtain the desired spacing and individual merchandise display areas. The patented system had no means for moving or feeding the merchandise.

For a number of important merchandising considerations, it is desirable that displayed merchandise be constantly conveyed forwardly so that the customer, or store clerk, is induced to remove the forwardmost article for purchase or sale. For example, if the goods are perishable or subject to becoming stale (e.g., cigarettes, fruit juices, dairy products, etc.), it is important that the articles be removed on a first-in-first-out basis to maintain freshness. Also, if the goods are removed in random or haphazard fashion, the result is unsightly disorder of the display. Furthermore, such shelf disorder makes more difficult routine operations like inventory control and merchandise re-stocking.

There thus exists a need for a shelf divider system having means for constantly moving the displayed merchandise forwardly for ready access thereof. Such a system should be simple to install and use, relatively inexpensive and completely flexible for use with merchandise of various sizes.

SUMMARY OF THE INVENTION

The present invention provides a simple to install and use stock shelf divider system having self-contained means for automatically moving the displayed merchandise forwardly,. The conveying means comprises a self-contained spring-urged pusher which is effective on any existing shelf, including those that are horizontal.

Briefly, the invention comprises a divider member and a pusher member slidably mounted on a track. A wound spring is connected to the track at the front end thereof and the coiled portion of the spring is retained o the pusher member. The divider member and track are frictionally and slidably mountable in a suitable channel member connectable to a shelf surface by adhesives, or the like. When operationally positioned, the track extends rearwardly over the shelf and the pusher member may be easily retracted to bear against goods positioned between it and the front channel member.

In one embodiment of the invention, the track is integral and coextensive with the divider member so that the divider and track are vertically oriented over the shelf, the pusher projects horizontally, and the shelf surface supports the goods.

In a second embodiment, the track comprises part of a floor section to which is integrally attached a vertical divider wall. Thus, the operationally positioned track is horizontal, the pusher member projects vertically, and the goods are supported by the floor of the shelf divider.

The inventive system may be quickly installed without the need for tools and is virtually foolproof in operation.

Numerous other advantages and features of the present invention will become apparent from the following detailed description of the invention, from the claims, and from the accompanying drawings.

BRIEF DESCRIPTION OF THE DRAWINGS

In the accompanying drawings forming a part of the specification, and in which like numerals are employed to designate like parts throughout.

DETAILED DESCRIPTION OF THE INVENTION

Figure 1:
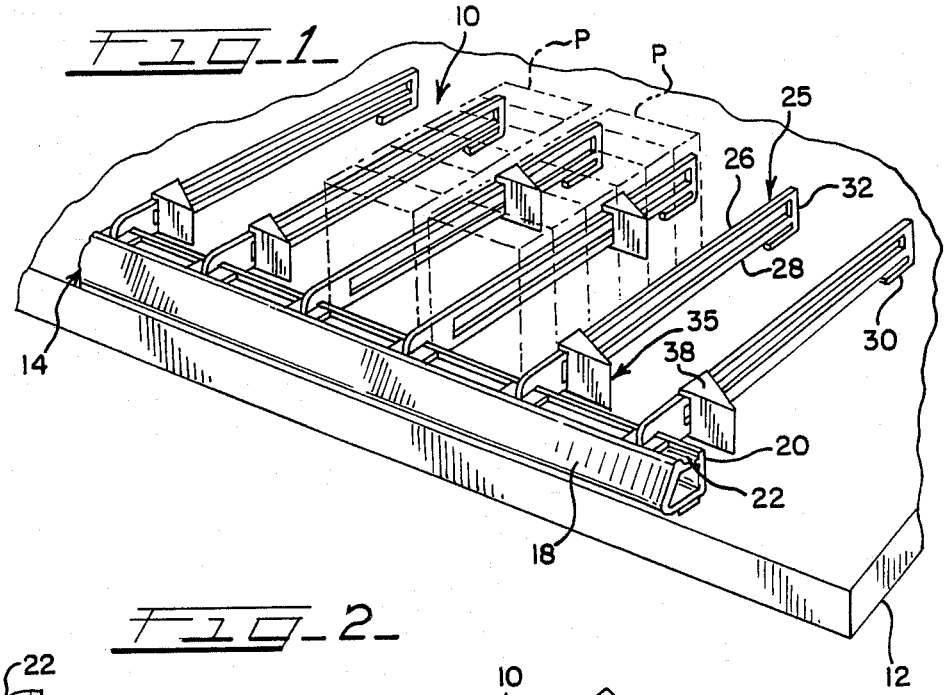
FIG. 1 is a perspective view showing a plurality of a spring-urged shelf divider system embodying the principles of the invention operationally mounted on a shelf.
Figure 2:
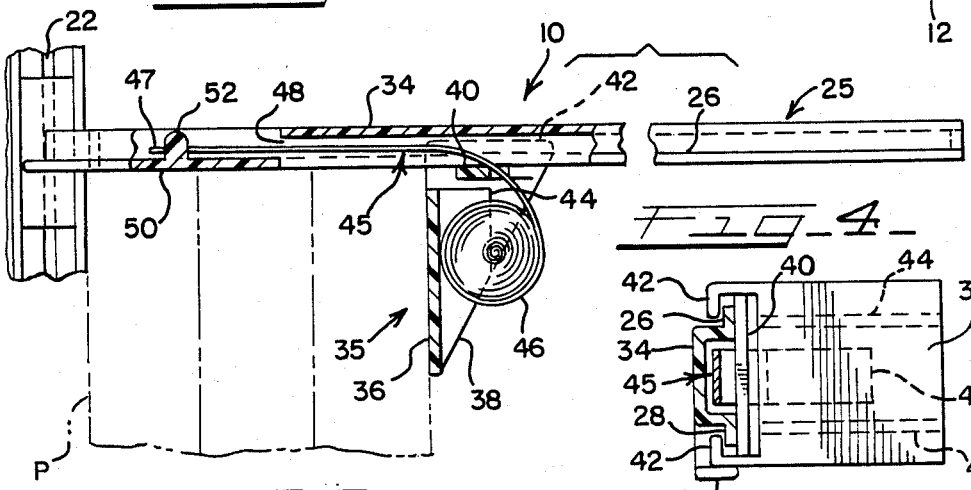
FIG. 2 is an enlarged fragmentary top plan view of a divider with portions broken away.

Referring to FIGS. 1 through 4 of the drawings, it will be seen that the reference numeral 10 indicates generally a preferred embodiment of the spring-urged shelf divider. A plurality of dividers 10 is shown in FIG. 1 in a typical operational arrangement on a shelf 12, the dividers being adjustably supported on the shelf by an elongated channel mounting member 14. Mounting member 14 is secured to the shelf 12 by any suitable means such as an adhesive mounting strip 16 (see FIG. 3). the mounting member 14 may be provided in any desired length to suit shelf conditions and preferably comprises an extrusion of suitable plastics having an attractively tapered front face 18 and a vertical rear wall 20 defining a resilient top-opening channel 22.

The divider 10 comprises an elongated track 25 having top and bottom rails 26 and 28, respectively. A spacer member 30 depends from the rear edge 32 of the track 25 and is adapted to operationally support the bottom rail 28 in raised relation to the shelf 12 to permit unobstructed movement of a pusher member on the track in the manner to be described. The track 25 comprises further a recessed outer wall 34 substantially coextensive with the rails 26 and 28. When operationally arranged as in FIG. 1, the walls 34 function as divider members to separate the shelf space into individual merchandise display areas.

Figure 4:
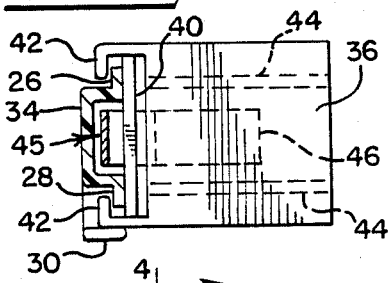
FIG. 4 is a sectional view on the plane of line 4—4 of FIG. 3.

A pusher member 35 is slidably mounted on the track 25, said pusher member comprising a front pusher face 36, generally triangular top and bottom walls 38,38, an end wall 40 and flanges 42,42 adapted to ride on the rails 26 and 28 (see FIG. 4). A pair of retaining walls 44,44 is integrally formed on the rear surface of the pusher face 36 and said walls cooperate with the end wall 40 to operationally retain the coil 46 of a spring 45. The opposite end 47 of the spring 45 is received through a slot 48 between the outer wall 34 and a front portion 50 of the track 25 where it is anchored to a post 52 integral on the front portion 50. It will thus be noted that the pusher member 35 may be withdrawn rearwardly against the urging of the spring 45 whereupon the played out portion of the spring lies in close proximity to the outer wall 34. Forward travel of the pusher member 35 is limited by a stop projection 54 formed on the rail 28.

Figure 3:
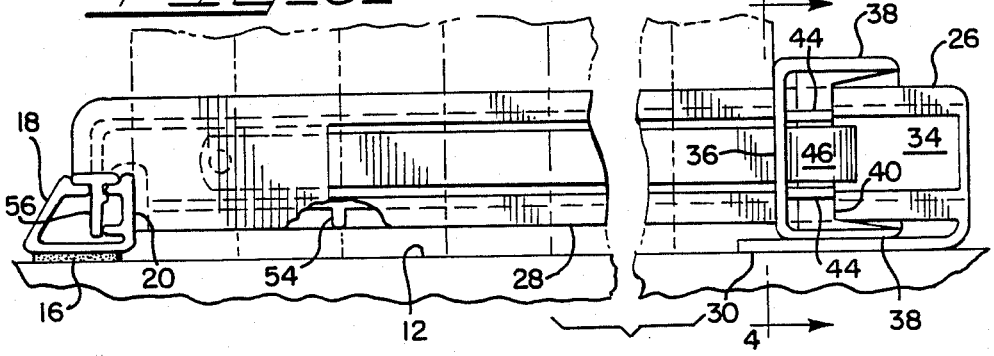
FIG. 3 is a fragmentary side elevational view of the divider.

Divider mounting means is provided on the track front portion 50, said mounting means comprising a depending tongue 56 adapted to be frictionally received and retained in the channel 22 of the mounting member 14 (see FIG. 3). The tongue 56 is capable of sliding movement within the mounting member so that a divider may be adjustably positioned as desired.

Operation of the shelf divider 10 should now be apparent. A plurality of operationally shelf-mounted dividers 10 are adjustably positioned to provide spacing suitable for accommodating the particular goods, such as, packages P of various brands of cigarettes. The pusher member 35 is withdrawn against the urging of the spring 45 and the packages P are placed upon the shelf 12 between the withdrawn pusher member and the rear wall 20 of the mounting member 14. As the front package in a column is removed, the remainder of the column is urged forwardly until exhausted.

Another embodiment of the invention is shown in FIGS. 5 through 9 of the drawings, wherein similar parts are identified with similar numerals with the suffix "a" added. Thus, spring-urged shelf dividers **10*a* are operationally and adjustably supported on a shelf 12*a* by an elongated channel mounting member 14*a* secured to the shelf by any suitable means such as an adhesive strip, or the like (not shown), said mounting member having a resilient top-opening channel 22*a***.

Divider **10*a* comprises a track 25*a* having horizontal side rails 26*a* and 28*a* and a recessed horizontal wall 34*a*. A pusher member 35*a* having a front pusher face 36*a* and a bottom wall 40*a* is slidably mounted on the rails 26*a* and 28*a* by means of the flanges 42*a*. Coil 46*a* of spring 45*a* is retained by retaining walls 44*a* and the opposite end 47*a* of the spring is anchored to a post 52*a* depending from a front portion 50*a* of the track 25*a*. Divider 10*a* comprises further an integral vertical divider wall 60 at one side thereof and a vertical front wall 62. When operationally arranged in abutting relationship as illustrated, the vertical divider walls 60 close the open side of the next adjacent divider 10*a*, except for the end divider (on the left as viewed in FIGS. 5 and 7), to provide self-contained merchandise display areas. Thus, when packages P are inserted, they rest upon the horizontal track 25*a*, but the spring-urged operation of the dividers 10*a* is otherwise the same as earlier described in dividers 10**.

Figure 5:
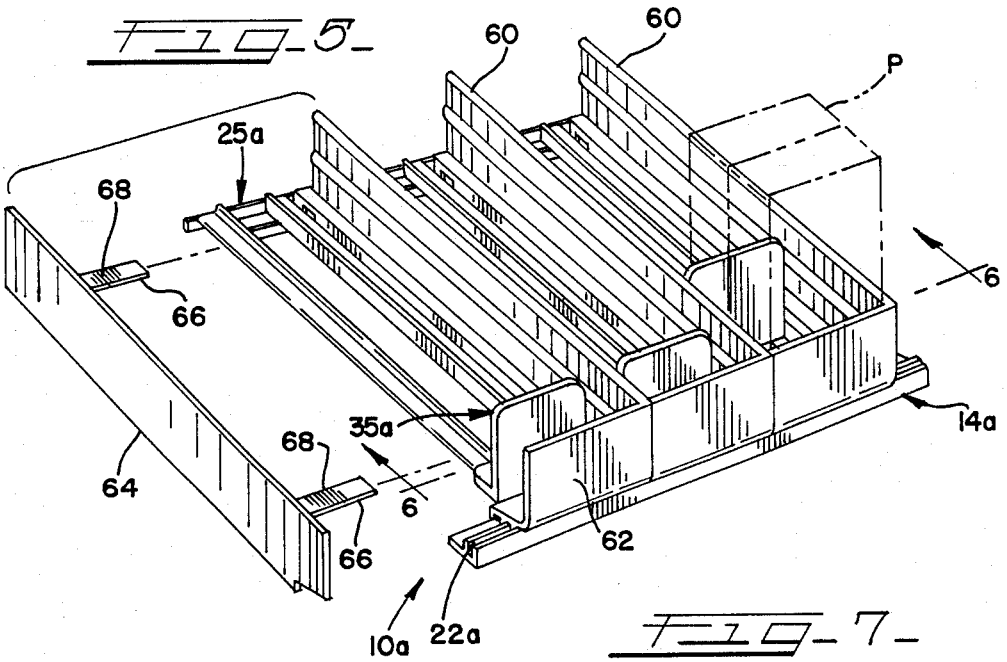
FIG. 5 is an exploded perspective view of another embodiment of the invention showing a plurality of the dividers as operationally mounted on a shelf.
Figure 7:
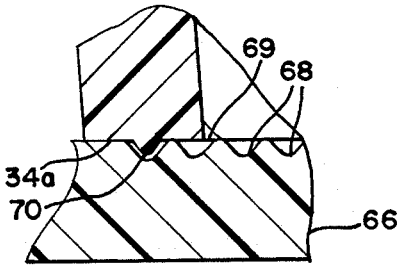
FIG. 7 is an enlarged sectional view on the plane of line 7—7 in FIG. 8 showing the cooperative engagement of the end closure wall with a divider.
Figure 6:
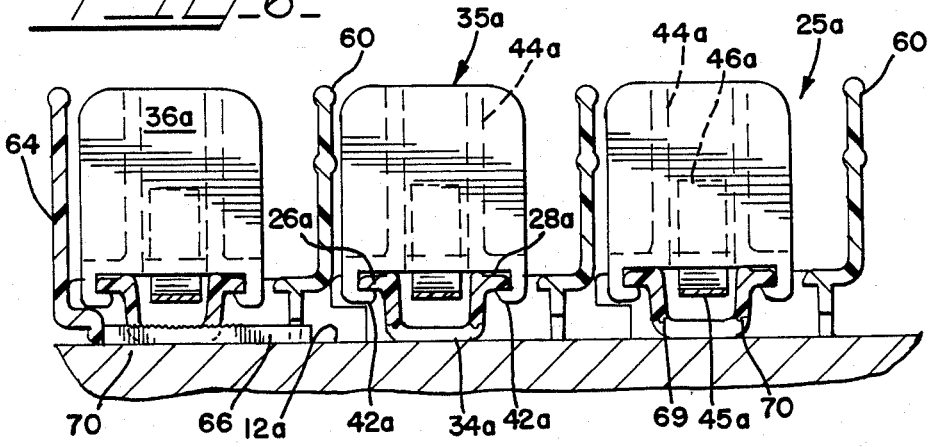
FIG. 6 is a vertical sectional view on the plane of line 6—6 of FIG. 5 with the end closure wall operationally engaged.
Figure 8:
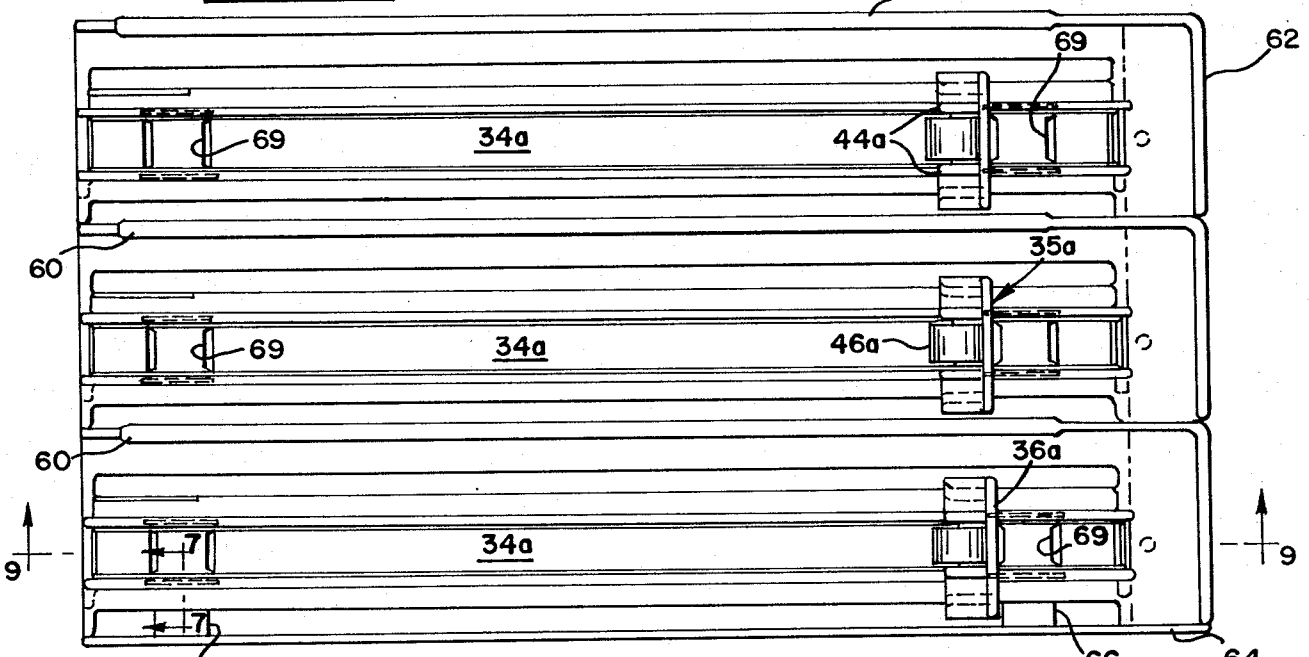
FIG. 8 is a top plan view of the operationally mounted dividers of FIG. 5.
Figure 9:
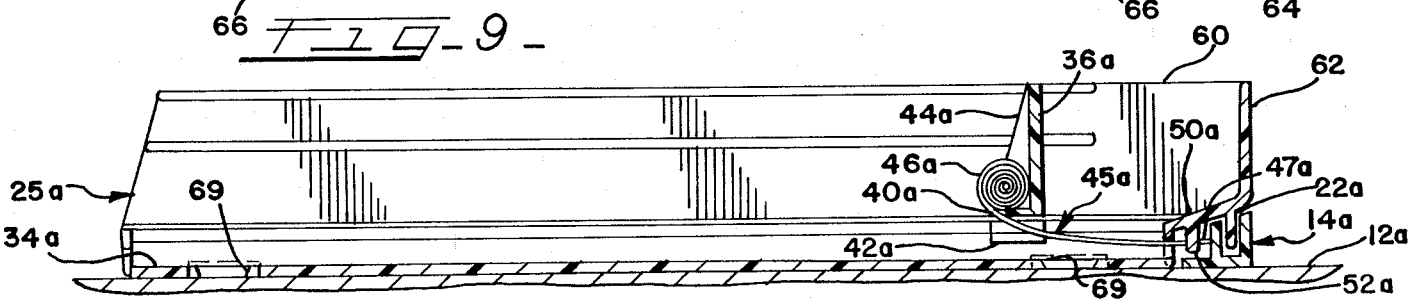
FIG. 9 is a vertical sectional view on the plane of line 9—9 in FIG. 8.

For purposes of closing off the open end of the leftmost divider **10*a*, there is provided a vertical sidewall 64 having positioning feet 66 formed with a series of spaced positioning grooves 68 (see FIGS. 5–7). The positioning feet 66 are receivable in slots 69 formed in the recessed wall 34*a*, and the grooves 68 are adapted to receive and engage a ridge 70 depending from the track wall defining the slots 69, whereby the spacing of the sidewall 64** may be adjusted as desired to accommodate a particular product and that adjusted spacing operationally retained.

It should now be apparent that the invention provides an inexpensive and simple-to-use divider system for organizing and aiding in the dispensing of 'goods on existing shelving. The spring-urged pusher means facilitates compact display of goods and first-in-first-out dispensing thereof.

It will be appreciated from the foregoing detailed description of the invention and illustrative embodiments thereof that numerous variations and modifications may be effected without departing from the true spirit and scope of the novel concept of the principles of the invention.

What is claimed is:

1. A shelf divider system comprising:

an elongated channel mounting member operationally securable to a front portion of a shelf;

a shelf divider member slidably receivable in said mounting member so that the divider member extend rearwardly over the shelf;

track means on said divider member comprising a pair of elongated rails, spring-urged pusher means comprising a pusher member having a front pusher face and a pair of flanges engaging said rails whereby said pusher member is operationally slidable on the rails and the pusher means is rearwardly retractable to accommodate a display of merchandise and will bear against the merchandise to automatically urge the same forwardly on the shelf.

2. A shelf divider system according to claim 1 wherein said pusher means comprises a pair of retainer walls projecting from the rear surface of said pusher face and a coiled spring operationally retained by said retainer walls so that the coil is capable of unwinding responsive to rearward pressure on the pusher member, the opposite end of the coiled spring being anchored to said divider member adjacent a front portion thereof.

3. A shelf divider system according to claim 2 wherein said track means comprises a recessed wall between said rails, whereby said spring when extended lies in close proximity to said recessed wall.

4. A shelf divider system according to claim 3 wherein said rails lie in a substantially vertical plane when said divider means is operationally positioned in said mounting member and said recessed wall comprises a shelf space divider wall in cooperation with an adjacent operationally positioned divider member.

5. A shelf divider system according to claim 4 comprising a spacer member depending from said divider member and resting on the shelf whereby the lower of said rails is raised from the shelf surface to permit unobstructed travel of said pusher member rearwardly on said rails.

6. A shelf divider system according to claim 3 comprising a divider wall substantially perpendicular to said track means and lying in a substantially vertical plane when said divider member is operationally positioned in said mounting member, said track means thereby lying on the surface of the shelf and providing a supporting surface for displayed merchandise.

7. A shelf divider system according to claim 6 comprising a closure wall connectable to said track means for closing the open side of the divider member opposite said divider wall, and means for adjusting the spacing between said divider wall and operationally, mounted closure wall.

8. A shelf divider system according to claim 7 wherein said last-mentioned means comprises a substantially horizontal foot projecting from said closure wall, a plurality of spaced positioning grooves on said foot and a depending ridge integral on said track means and receivable in said positioning grooves.

9. A shelf divider system comprising:

an elongated channel mounting member operationally securable to a front portion of a shelf;

a shelf divider member comprising a vertical divider wall and a horizontal track with rails integral therewith, a closure wall connectable to said track for closing the open side of the divider member opposite said divider wall, and means for adjusting the spacing between said divider wall and the operationally mounted closure wall comprising a horizontal foot projecting from said closure wall, a bottom slot in said track adapted to receive said foot therein, a plurality of spaced positioning grooves on said foot and a depending ridge integral on said track and receivable in said positioning grooves, said divider member being slidably receivable in said mounting member whereby said track rests on the shelf;

a pusher member slidably mounted on said rails; and a coil anchored at one end to a front portion of said divider member and the coil thereof operationally retained on said pusher member, whereby said pusher member is rearwardly retractable to accommodate displayed merchandise supported on said track and automatically urged forwardly thereon.

* * * * *